United States Patent [19]

Ulveling

[11] 4,395,166

[45] Jul. 26, 1983

[54] FLUIDIZATION AND DISTRIBUTION

[75] Inventor: Leon Ulveling, Howard, Luxembourg

[73] Assignee: Paul Wurth S.A., Luxembourg

[21] Appl. No.: 247,511

[22] Filed: Mar. 25, 1981

[30] Foreign Application Priority Data

Apr. 4, 1980 [LU] Luxembourg ..... 82336

[51] Int. Cl.[3] ..... B65G 53/36

[52] U.S. Cl. ..... 406/124; 406/146; 75/42; 266/81; 266/187

[58] Field of Search ..... 406/118, 124-126, 406/144, 146, 195, 194, 24, 25; 266/182, 186, 187, 81; 75/42

[56] References Cited

U.S. PATENT DOCUMENTS

| | | | |
|---|---|---|---|
| 3,762,773 | 10/1973 | Schroeder | 406/146 X |
| 4,067,623 | 1/1978 | Klein et al. | 406/124 |
| 4,108,500 | 8/1978 | Stamer | 406/124 X |

*Primary Examiner*—John J. Love
*Assistant Examiner*—Paul A. Sobel
*Attorney, Agent, or Firm*—David S. Fishman

[57] ABSTRACT

A pulverized material, particularly coal or lignite, is maintained in a fluidized state in a storage container and is released therefrom into a carrier gas stream. The gas for causing fluidization and maintaining a pressure in the container which is greater than the carrier gas pressure is in part obtained by recycling gas vented from the container, the vented gas being filtered and increased in pressure. The vented gas may also be employed to aid in the delivery of the pulverized material into the container.

20 Claims, 1 Drawing Figure

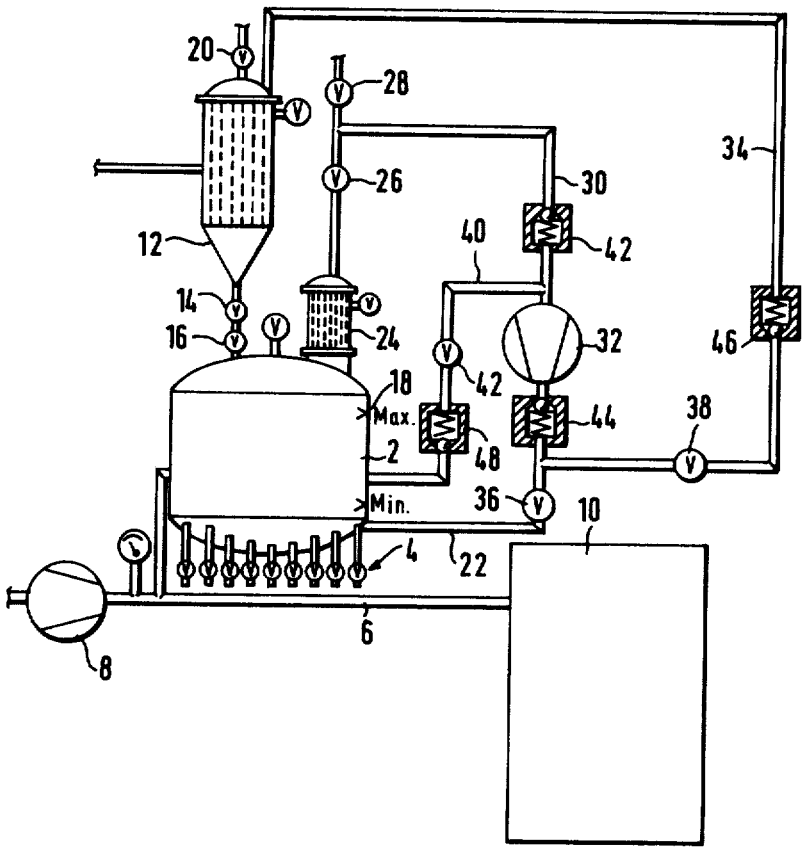
20
28
34
26
30
12
40
42
14
16
24
32
46
18
42
Max.
44
38
2
48
Min.
36
10
4
22
6
8

FLUIDIZATION AND DISTRIBUTION

BACKGROUND OF THE INVENTION (1) Field of the Invention

The present invention relates to the transport of pulverized material and particularly to the fluidization of a stored quantity of such material and the subsequent distribution of the thus fluidized material. More specifically, this invention is directed to apparatus for the handling of pulverized material and particularly to a system which permits the reliable and economic delivery of such material into a stream of carrier gas for transport a consuming device. Accordingly, the general objects of the present invention are to provide novel and improved methods and apparatus for such character.

(2) Description of the Prior Art

While not limited thereto in its utility, the present invention is particularly well suited for use in the delivery of pulverized coal or lignite to the tuyeres of a blast furnace. The advantages incident to the injection of a pulverized solid fuel into a blast furnace are known in the art and a system for transporting pulverized solid fuel for this purpose is disclosed in copending U.S. patent application Ser. No. 158,612 filed June 11, 1980 and assigned to the assignee of the present invention. In the installation of the referenced copending application, the pulverized fuel is extracted from the bottom of a final storage container, via extraction orifices which are provided with rotary feeders, and pneumatically conveyed to each of the tuyeres of a blast furnace. The system of the copending application also includes an intermediate material storage tank or chamber from which the pulverized material is fed into the final storage container. This intermediate storage chamber is alternately aerated and subjected to a pressure which is equal to or greater than the pressure prevailing in the final storage container whereby, during the pressurization portion of the cycle, the pulverized material may be deliver4d from the intermediate chamber into the final storage container.

In order to uniformly evacuate the pulverized material from the final storge container via the rotary feeders, the pressure inside this storage container must be higher than the pneumatic transport pressure at the downstream side of the rotary feeders. It is also vital that the mass inside the final storage container be completely fluid. As a means of fulfilling these two requisite operating conditions, and as disclosed in said copending application Ser. No. 158,612, a pressurized gas must be injected into the final storage container in order to insure the required fluidization and interior pressure. This pressurized gas is typically air and the storage container will be provided with a pressure-regulation device which automatically operates to prevent over pressurization of the storage container.

While apparatus of the type discussed briefly above and disclosed in copending application Ser. No. 158,612 satisfactorily achieve the requisite operating conditions, such apparatus also consumes a considerable quantity of pressurized gas. By way of example, under typical operating conditions a storage enclosure having a diameter of 3.8 m would require 21 kg of pressurized air per minute. These pressurized air requirements can be met only through the use of compressors which are comparatively expensive to install, operate and maintain.

SUMMARY OF THE INVENTION

The present invention overcomes the above-briefly discussed and other deficiencies and disadvantages of the prior art by providing a novel and improved process for the fluidization of pulverized material within a storage container and for achieving the requisite degree of pressurization of such a container. The present invention also contemplates novel apparatus for use in the practice of such process, this novel apparatus being characterized by a comparatively moderate level of consumption of compressed gas.

A process in accordance with the present invention has two phases of operation. During a first phase the intermediate storage tank is isolated from the downstream or main storage container and a pressurized gas is injected into the main storage container. This pressurized gas is, during the first phase, recycled so as to be re-injected into the container subsequent to filtration and repressurization as required. The requisite degree of repressurization is performed in a compressor. During a second phase of operation, when the intermediate storage tank is in communication with the main storage container, forced circulation of the pulverized material is effected by means of the pressurized gas which is injected into the intermediate tank, evacuated from the main storage container and re-injected into the intermediate tank subsequent to repressurization.

In accordance with a preferred embodiment, the same gas is employed in each of the two above-discussed phases and thus the gas evacuated from the main or distribution container is alternately re-injected into the main container and injected into the intermediate tank.

Also in accordance with the preferred embodiment of the present invention, during the aforesaid second phase the gas evacuated from the main storage or distribution container is divided into two streams, subsequent to repressurization, and one of these streams is directed into the intermediate tank while the other stream is re-injected into the main storage-distribution container.

In accordance with the present invention the recycling of the pressurized gas, which is withdrawn from the main storage container via a filter, enables the consumption of this gas to be considerably reduced. However, since there will be losses, a supplementary source of pressurized gas is provided. This supplementary source, however, supplies only that quantity of gas required to make up for the losses.

Apparatus in accordance with a preferred embodiment of the present invention comprises a first pneumatic circuit which connects an evacuation aperture provided in the upper portion of the main storage container with a gas supply aperture located adjacent the base of this container. The apparatus also includes a second pneumatic circuit which connects said main storage container evacuation aperture to a compressed gas supply aperture for the intermediate storage tank. The first and second pneumatic circuits have a common branch and means, a compressor for example, is inserted in this common branch for increasing the pressure of the gas flowing therethrough. The first and second pneumatic circuits each include flow control valves.

BRIEF DESCRIPTION OF THE DRAWING

The present invention may be better understood and its numerous objects and advantages will become apparent to those skilled in the art by reference to the accompanying drawing which is a schematic illustration of apparatus in accordance with a preferred embodiment. The apparatus shown in the drawing of the present application may be employed as a portion of the system depicted in the above-referenced copending application Ser. No. 158,612.

DESCRIPTION OF THE PREFERRED EMBODIMENT

With reference now to the drawing, a main storage or distribution container is indicated at 2. In the environment of a blast furnace, wherein a pulverized solid fuel is to be injected into the furnace via the tuyeres, powdered coal or lignite would be stored in container 2 for subsequent injection into a furnace 10. The pulverized material is extracted from container 2 via a plurality of feeder devices, indicated generally at 4, which may be rotary air-lock feeders or any other type of feed device having blowing chambers and honeycomb-type rotors. The feed devices 4 permit the pulverized fuel to be delivered into a conduit 6 wherein the fuel is entrained in a stream of pressurized carrier gas provided by a compressor 8.

The pulverized fuel is delivered from a source, such as the source described in referenced copending application Ser. No. 158,612, into an intermediate storage tank 12 via a feed conduit 13. Comunication between the tank 12 and the container 2, so as to deliver the pulverized fuel from tank 12 into container 2, is via a pair of series connected valves 14 and 16. Valves 14 and 16 are automatically controlled by a level detection system, indicated at 18, which automatically senses preselected minimum and maximum levels of material within the container 2. The tank 12, during periods when it is receiving pulverized fuel, is isolated from container 2 by means of the valves 14 and 16 and is aerated by pressurized gas delivered via valve 20. If the system for entrainment and subsequent injection of the pulverized fuel into the furnace 10 is to function correctly, the pressure in container 2 must be higher than the pressure in furnace 10. During periods when material is being delivered from tank 12 into container 2, the pressure in tank 12 must be at least equal to the pressure prevailing in container 2.

In order to maintain adequate pressure in container 2, and to insure optimum fluidization of the pulverulent mass, a pressurized gas is injected into container 2 by means of conduit 22. This pressurized gas will preferably and typically be air. The pressure within container 2 is regulated by means of an automatic pressure regulating valve 28 which is coupled to the interior of container 2 by means of a flow control valve 26 and a filter 24. Valve 28 is calibrated to a preselected reference pressure and, should this pressure be exceeded, gas will be vented, typically to the ambient atmosphere, from container 2.

In order to avoid excessive consumption of compressed air or other gas, as the gas is injected into container 2 under pressure via conduit 22, the apparatus in accordance with present invention includes a recycling circuit including conduit 30. Conduit 30 is coupled to the vent line from container 2 upstream of the pressure regulating valve 28 but downstream of filter 24. Conduit 30 recycles the "surplus" air back to the pressurized gas supply conduit 22 and thus cooperates with conduit 22 to define a first closed circuit. The circulation in conduit 30 is controlled by means of the aforementioned valve 26 which is, accordingly, located downstream of filter 24 but upstream of the junction with conduit 30. Since there will be pressure losses in the circuit, a pressure increasing device 32, for example, a compressor, is installed in conduit 30.

An auxiliary conduit 34 connects conduit 30, at a point downstream of compressor 32, with the top of the intermediate tank 12. The compressed gas recycled via conduit 30 may thus be re-injected into container 2 via conduit 22 and/or may be delivered into tank 12 via conduit 34. The control of the pressure in conduits 22 and 34 is effected by means of respective flow control valves 36 and 38.

In order to compensate for losses of gas, for example through the feeders 4, a supplemental source of pressurized gas is provided. In the disclosed embodiment this supplemental source comprises a supply conduit 40 which is connected to the furnace fuel supply conduit 6 downstream of compressor 8 and upstream of the feeders 4. The flow through supplementary supply conduit 40, which connects with conduit 30 upstream of compressor 32, is controlled by means of a valve 42.

In order to insure circulation in the correct direction in each of the above-discussed conduits, check valves 42, 44, 46 and 48 are provided.

During a first phase of operation, when the pulverized fuel is being withdrawn from container 2 and container 2 is isolated from intermediate tank 12 by means of valves 14 and 16, the tank 12 will be in a filling phase. Under these conditions air under pressure is circulated in a closed circuit defined by conduit 22, container 2, filter 24 and recycling conduit 30. The aforementioned flow is permitted by reason of the operation of the compressor 32. In order to compensate for the reduction of volume of material within container 2 resulting from the withdrawal therefrom of the pulverized fuel, a quantity of air under pressure is injected into conduit 30 via supplementary supply conduit 40 and valve 42. If the pressure in container 2 and recycling conduit 30 should exceed the reference level to which valve 28 is calibrated during this phase of operation, valve 28 will automatically open to vent gas from the system and restore the selected maximum pressure.

When the level of the pulverulent mass in container 2 reaches the minimum level as sensed by device 18, the valves 14 and 16 will be open to establish communication between tank 12 and container 2. During this phase, in which the container 2 is being filled, and in order to insure the transfer of the contents of intermediate tank 12 into container 2, the valve 38 will be opened and pressurized gas will be delivered to tank 12 via conduit 34. At this time the valve 36 may be either closed or partially opened and thus the air recycled through conduit 30 will be either totally or partly supplied to tank 12 in order to cause the pulverulent material to flow into container 2. As soon as the maximum level is reached in the container 2, or intermediate tank 12 has been emptied, the valves 14 and 16 will be closed. The closing of valves 14 and 16 is simultaneously accompanied by the closing of valve 38 and thus the system returns to the first phase of operation wherein the closed circuit comprising conduits 30 and 22 only is activated.

While a preferred embodiment has been shown and described, various modifications and substitutions may be made thereto without departing from the spirit and scope of the invention. Accordingly, the present invention has been described by way of illustration and not limitation.

What is claimed is:

1. In a process for transportation of a pulverized material, the material being delivered to and temporarily stored in a first container and being subsequently fed from the first container to a second container, the material being thereafter withdrawn from the second container and fluidically conveyed to a consuming device, the improvement comprising:

injecting a pressurized gas into the second container to maintain a pressure therein greater than the consuming device pressure;

venting some of said gas from the second container;

filtering pulverized material from the vented gas;

increasing the pressure of the vented and filtered gas;

re-injecting at least a portion of the vented and pressurized gas into the second container;

selectively delivering gas to the first container at a pressure which is at least as high as the pressure within the second container;

establishing communication between the first and second containers during the delivery of pressurized gas to the first container whereby the pressurized gas aids in feeding material from the first container into the second container; and continuing to vent gas from the second container during the time that communication is established between the containers whereby at least a portion of the gas injected into the second container is filtered, increased in pressure and thereafter delivered to the first container.

2. In the process of claim 1 wherein the gas delivered to first container and the gas injected into the second container emanate from a common source.

3. The process of claim 1 wherein the step of delivering gas to the first container comprises:

diverting at least a portion of the filtered and pressurized gas vented from the second container and directing said diverted gas to the first container.

4. The process of claim 1 wherein the pressure and volume of gas delivered to the second container at least during periods when there is no communication between the first and second containers is sufficient to maintain the pulverized material in the second container in a fluidized state.

5. The process of claim 1 wherein the steps of injecting and delivering are performed alternately.

6. The process of claim 1 further comprising:

periodically receiving compressurized gas from a supplemental source and adding said periodically received gas to the gas flowing through the second container.

7. The process of claim 6 wherein the periodically received gas is mixed with the filtered gas vented from the second container prior to increasing the pressure thereof.

8. The process of claim 7 wherein the step of delivering gas to the first container comprises:

diverting at least a portion of the filtered and pressurized gas vented from the second container and directing said diverted gas to the first container.

9. The process of claim 8 wherein the pressure and volume of the gas delivered to the second container at least during periods when communication is not established between the first and second containers is sufficient to maintain the pulverized material in the second container in a fluidized state.

10. The process of claim 9 wherein the gas is air and the pulverized material is combustible.

11. The process of claim 10 wherein the steps of injecting and delivering are performed alternately whereby all of the gas vented from said second container is delivered to the first container during periods when communication is established between the first and second containers.

12. The process of claim 10 further comprising the step of:

supplying pulverized material to said first container at least during periods when communication is not established between the first and second containers.

13. Apparatus for use in the conveying of pulverulent material comprising:

an intermediate storage tank, said intermediate tank receiving the material from a source;

a final storage container;

means for selectively establishing communication between said tank and said container whereby material may be transferred from the tank into said container;

means for withdrawing material from said container and entraining the withdrawn material in a carrier fluid;

means for injecting a pressurized gas into said container to establish pressure therein in excess of the pressure of the carrier fluid;

means for venting gas from said container;

first fluid circuit means for conducting the gas passing through said venting means to said injecting means whereby the vented gas is re-injected into said container, said first fluid circuit means including means for filtering pulverized material from the vented gas and means for increasing the pressure of the filtered gas; and second fluid circuit means for supplying at least a portion of pressurized gas from said container to said tank at least during periods when said communication establishing means is permitting the transfer of material, said pressurized gas aiding in the movement of material from said tank into said container.

14. The apparatus of claim 13 wherein said second fluid circuit means comprises:

means for diverting at least a portion of the vented gas subsequent to passage through said pressure increasing means and upstream of said injecting means.

15. The apparatus of claim 14 further comprising:

means for controlling the flow in said first fluid circuit means and in said second fluid circuit means.

16. The apparatus of claim 15 further comprising:

means for furnishing a pressurized gas to said first fluid circuit means from a supplemental source to make up for losses.

17. The apparatus of claim 16 further comprising:

pressure regulating means for establishing a maximum pressure in said container.

18. The apparatus of claim 17 wherein the pressure and volume of the gas injected into said container are sufficiently great to insure that the material therein is in a fluidized state.

19. The apparatus of claim 18 wherein said furnishing means is coupled to said first fluid circuit means at a point upstream of said pressure increasing means.

20. The apparatus of claim 19 wherein the gas is air, the pulverulent material is combustible and wherein said apparatus further includes means for aerating said tank when said communication establishing means is in the closed state.

* * * * *